US006012260A

United States Patent [19]

Hendrick et al.

[11] Patent Number: 6,012,260

[45] Date of Patent: Jan. 11, 2000

[54] AIR VENT INSERT

[76] Inventors: Robert W. Hendrick; Robin Hendrick, both of 4038-16 Pleasant Grove Church Rd., Shelby, N.C. 28150

[21] Appl. No.: 09/146,500

[22] Filed: Sep. 3, 1998

[51] Int. Cl.[7] ..... E04B 1/70

[52] U.S. Cl. ..... 52/302.1; 52/302.3; 52/203; 52/198; 52/473; 52/656.7

[58] Field of Search ..... 52/302.1, 302.3, 52/202, 203, 656.7, 473, 198, 199; 403/408.1; 411/174

[56] References Cited

U.S. PATENT DOCUMENTS

| | | | |
|---|---|---|---|
| 2,537,302 | 1/1951 | Chitra, Jr. | 52/202 |
| 2,709,402 | 5/1955 | Malm | 52/302.1 X |
| 3,392,486 | 7/1968 | Luke | 52/202 X |
| 3,950,904 | 4/1976 | Littman | 52/473 X |
| 4,669,371 | 6/1987 | Sarazen, Jr. et al. | 52/302.1 X |
| 5,758,457 | 6/1998 | Achen | 52/302.1 X |

*Primary Examiner*—Carl D. Friedman
*Assistant Examiner*—Phi Dieu Tran A

[57] ABSTRACT

An air vent insert for mounting to the perimeter of a vent opening in a building structure to provide threaded mounting holes for an air vent cover. The insert includes an open frame having front and back faces, generally rectangular inner and outer perimeter edges, a spaced apart pair of elongate end members and a spaced apart pair of elongate side members extending between the end members. The inner perimeter edge of the frame defines a central opening. The frame is designed for mounting to a building structure around the periphery of an air vent opening in the building structure such that the center opening of the frame extends around the outer periphery of the air vent opening in the building structure. The frame is also designed for mounting an air vent cover thereto such that the air vent cover substantially covers the central opening.

1 Claim, 3 Drawing Sheets

AIR VENT INSERT

BACKGROUND OF THE INVENTION

1. Field of the Invention

The present invention relates to air vent inserts and more particularly pertains to a new air vent insert for mounting to the perimeter of a vent opening in a building structure to provide threaded mounting holes for an air vent cover.

2. Description of the Prior Art

The use of air vent inserts is known in the prior art. More specifically, air vent inserts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,684,305; U.S. Pat. No. 5,163,871; U.S. Pat. No. 2,037,176; U.S. Pat. No. 2,062,685; U.S. Pat. No. 4,729,292; and U.S. Pat. No. Des. 380,259.

While these devices fulfill their respective, particular objectives and requirements, the aforementioned patents do not disclose a new air vent insert. The inventive device includes an open frame having front and back faces, generally rectangular inner and outer perimeter edges, a spaced apart pair of elongate end members and a spaced apart pair of elongate side members extending between the end members. The inner perimeter edge of the frame defines a central opening. The frame is designed for mounting to a building structure around the periphery of an air vent opening in the building structure such that the center opening of the frame extends around the outer periphery of the air vent opening in the building structure. The frame is also designed for mounting an air vent cover thereto such that the air vent cover substantially covers the central opening.

In these respects, the air vent insert according to the present invention substantially departs from the conventional concepts and designs of the prior art, and in so doing provides an apparatus primarily developed for the purpose of mounting to the perimeter of a vent opening in a building structure to provide threaded mounting holes for an air vent cover.

SUMMARY OF THE INVENTION

In view of the foregoing disadvantages inherent in the known types of air vent inserts now present in the prior art, the present invention provides a new air vent insert construction wherein the same can be utilized for mounting to the perimeter of a vent opening in a building structure to provide threaded mounting holes for an air vent cover.

The general purpose of the present invention, which will be described subsequently in greater detail, is to provide a new air vent insert apparatus and method which has many of the advantages of the air vent inserts mentioned heretofore and many novel features that result in a new air vent insert which is not anticipated, rendered obvious, suggested, or even implied by any of the prior art air vent inserts, either alone or in any combination thereof.

To attain this, the present invention generally comprises an open frame having front and back faces, generally rectangular inner and outer perimeter edges, a spaced apart pair of elongate end members and a spaced apart pair of elongate side members extending between the end members. The inner perimeter edge of the frame defines a central opening. The frame is designed for mounting to a building structure around the periphery of an air vent opening in the building structure such that the center opening of the frame extends around the outer periphery of the air vent opening in the building structure. The frame is also designed for mounting an air vent cover thereto such that the air vent cover substantially covers the central opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new air vent insert apparatus and method which has many of the advantages of the air vent inserts mentioned heretofore and many novel features that result in a new air vent insert which is not anticipated, rendered obvious, suggested, or even implied by any of the prior art air vent inserts, either alone or in any combination thereof.

It is another object of the present invention to provide a new air vent insert which may be easily and efficiently manufactured and marketed.

It is a further object of the present invention to provide a new air vent insert which is of a durable and reliable construction.

An even further object of the present invention is to provide a new air vent insert which is susceptible of a low cost of manufacture with regard to both materials and labor, and which accordingly is then susceptible of low prices of sale to the consuming public, thereby making such air vent insert economically available to the buying public.

Still yet another object of the present invention is to provide a new air vent insert which provides in the apparatuses and methods of the prior art some of the advantages thereof, while simultaneously overcoming some of the disadvantages normally associated therewith.

Still another object of the present invention is to provide a new air vent insert for mounting to the perimeter of a vent opening in a building structure to provide threaded mounting holes for an air vent cover.

Yet another object of the present invention is to provide a new air vent insert which includes an open frame having front and back faces, generally rectangular inner and outer perimeter edges, a spaced apart pair of elongate end members and a spaced apart pair of elongate side members extending between the end members. The inner perimeter edge of the frame defines a central opening. The frame is designed for mounting to a building structure around the periphery of an air vent opening in the building structure such that the center opening of the frame extends around the outer periphery of the air vent opening in the building structure. The frame is also designed for mounting an air vent cover thereto such that the air vent cover substantially covers the central opening.

Still yet another object of the present invention is to provide a new air vent insert that allows secure attachment of an air vent cover to the building structure when the original mounting holes in the building structure have become either too large or stripped thereby preventing secure fastening of the air vent cover to the building structure.

Even still another object of the present invention is to provide a new air vent insert that prevents loose air vent covers over air vent opening in building structures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
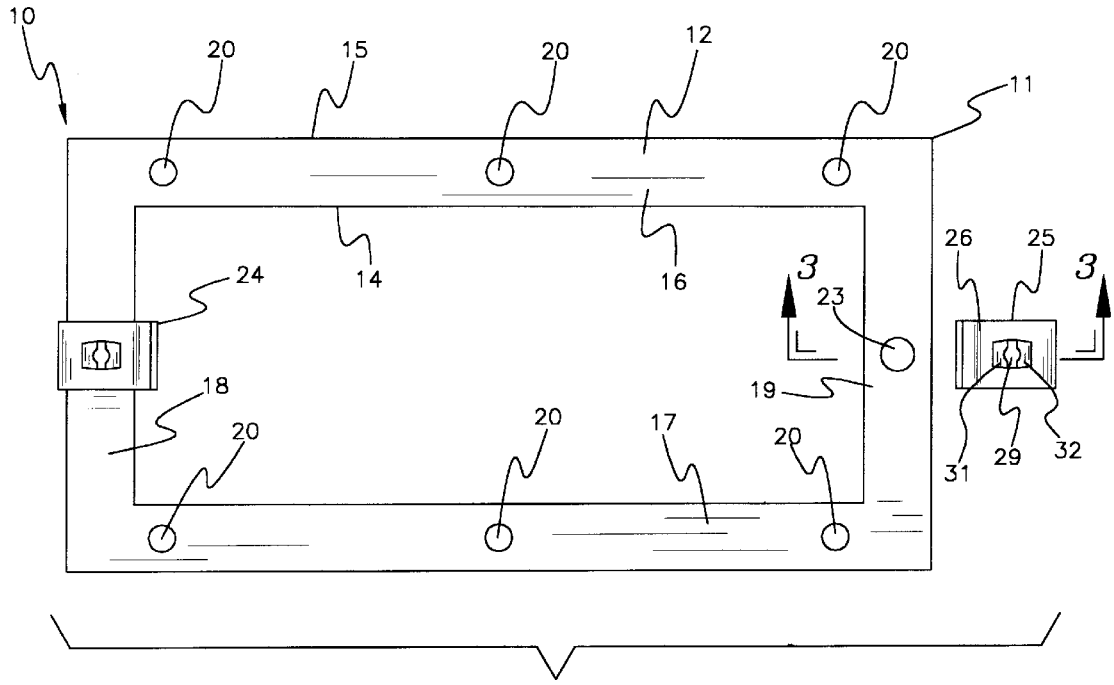
FIG. 1 is a schematic front side view of a new air vent insert according to the present invention.
Figure 2:
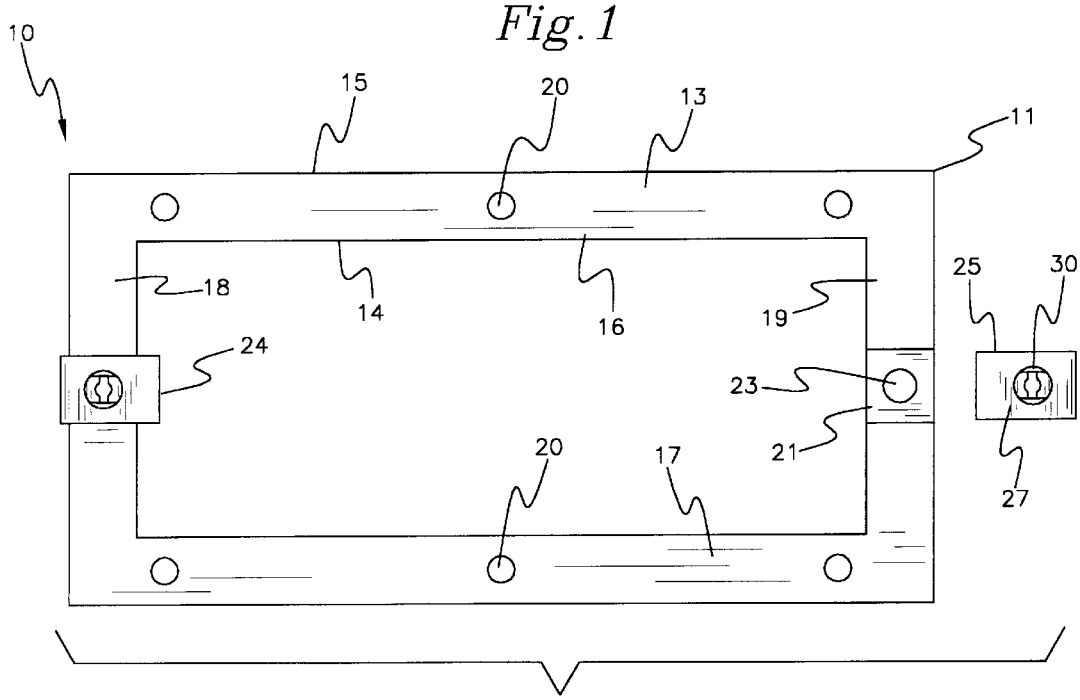
FIG. 2 is a schematic back side view of the present invention.
Figure 3:
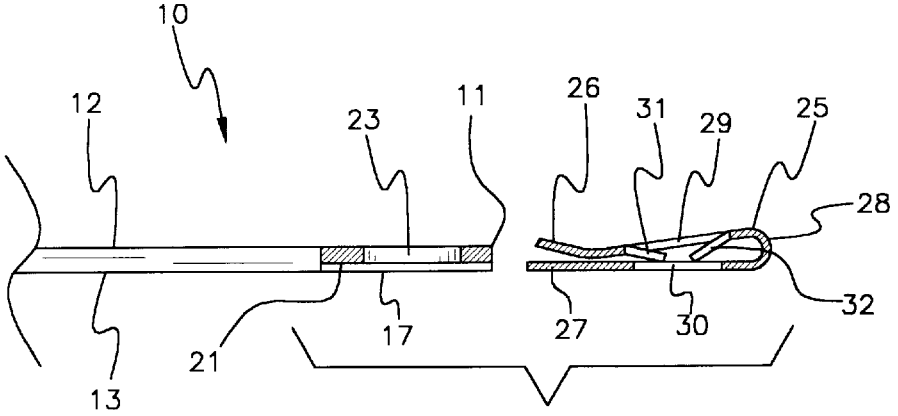
FIG. 3 is a schematic cross sectional view of the present invention taken from line 3—3 of FIG. 1.
Figure 4:
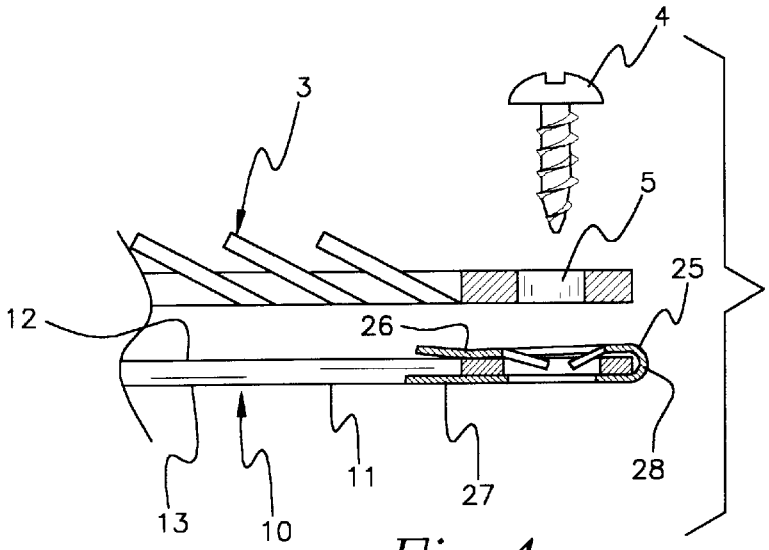
FIG. 4 is a schematic exploded cross-sectional view of the present invention and an air vent cover.

With reference now to the drawings, and in particular to FIGS. 1 through 5 thereof, a new air vent insert embodying the principles and concepts of the present invention and generally designated by the reference numeral 10 will be described.

In use, the insert 10 is designed for mounting to a building structure 1 around the periphery of an generally rectangular air vent opening 2 in the building structure 1 to permit mounting of an louvered air vent cover 3 over the air vent opening 2. The air vent cover 3 typically has a pair of end holes 5 designed for extending fasteners 4 therethrough for securing the air vent cover 3 to the building structure 1. As best illustrated in FIGS. 1 through 5, the air vent insert 10 generally comprises an open frame 11 having front and back faces 12,13, generally rectangular inner and outer perimeter edges 14,15, a spaced apart pair of elongate end members 16,17 and a spaced apart pair of elongate side members 18,19 extending between the end members 16,17. The inner perimeter edge 14 of the frame 11 defines a central opening. The frame 11 is designed for mounting to a building structure 1 around the periphery of an air vent opening 2 in the building structure 1 such that the center opening of the frame 11 extends around the outer periphery of the air vent opening 2 in the building structure 1. The frame 11 is also designed for mounting an air vent cover 3 thereto such that the air vent cover 3 substantially covers the central opening.

In closer detail, the insert comprises an open frame 11 generally rectangular in configuration and having front and back faces 12,13, generally rectangular inner and outer perimeter edges 14,15, a spaced apart pair of elongate end members 16,17 and a spaced apart pair of elongate side members 18,19 extending between the end members 16,17. The inner perimeter edge 14 of the frame 11 defines a generally rectangular central opening. In use, the frame 11 is designed for mounting to a building structure 1 around the periphery of an air vent opening 2 in the building structure 1 such that the back face 13 of the frame 11 abuts the building structure 1 and the center opening of the frame 11 extends around the outer periphery of the air vent opening 2 in the building structure 1. The front face 12 of the frame 11 is designed for abutting an louvered air vent cover 3 thereagainst such that the air vent cover 3 substantially covers the central opening.

Preferably, the front and back faces 12,13 of the frame 11 generally lie in generally parallel planes to one another. In this preferred embodiment, the end members 16,17 of the frame 11 are extended generally parallel to one another and the side members 18,19 of the frame 11 are extended generally parallel to one another and generally perpendicular to the end members 16,17 of the frame 11. The frame 11 has a thickness defined between the front and back faces 12,13 of the frame 11, a length defined between the end members 16,17 of the frame 11 and a width defined between the side members 18,19 of the frame 11. In an ideal illustrative embodiment, the frame 11 is sized to fit behind an air vent cover 3 for the air vent opening 2 Ideally, the thickness of the frame 11 is about 1/16 inch, the length of the frame 11 is about 8 inches, and the width of the frame 11 is about 4 inches.

Each of the side members 18,19 of the frame 11 has a plurality of mounting holes 20 therethrough between the front and back faces 12,13 of the frame 11. Preferably, the plurality of mounting holes 20 of each of the side member 18,19 comprises three mounting holes 20 spaced apart along the respective side member 18,19 at generally equal intervals. In use, each of the mounting holes 20 is designed for extending a threaded fastener 4 therethrough into the building structure 1 to secure the frame 11 to the building structure 1.

Each of the end members 16,17 preferably has a generally rectangular mortise 21 in the back face 13 of the respective end member 16,17 and extending between the inner and outer perimeter edges 14,15 of the frame 11. Each of the mortises 21 is generally positioned on the respective end member 16,17 at a midpoint between the side members 18,19 of the frame 11. Each of the end members 16,17 of the frame 11 also has a receiving hole 22 therethrough between the front and back faces 12,13 of the frame 11. Each receiving hole 22 extends through the mortise 21 of the respective end member 16,17.

A pair of mounting clips 24 are also provided. Each of the mounting clips 24 is associated with an end member 16,17 of the frame 11. Each of the mounting clips 24 is generally U-shaped and has a pair of resiliently deflectable arms 26,27 and an arcuate portion 28 connecting the arms 26,27 together. The arms 26,27 are biased towards one another. Each mounting clip 24 receives the associated end member 16,17 of the frame 11 between the arms 26,27 of the respective mounting clip 24 such that the mounting clips 24 are held to the associated end members 16,17 of the frame 11 by the biasing forces of the arms 26,27 towards each other. One arm 27 of each mounting clip 24 is positioned in the mortise 21 of the associated end member 16,17. Each of the arms 26,27 of each mounting clip 24 has an aperture 29,30 therethrough. The apertures 29,30 of each mounting clip 24 are generally coaxial to one another. The apertures 29,30 of the mounting arms 26,27 are also generally coaxial with the receiving hole 22 of the associated end member 16,17 of the frame 11. In use, each associated group of apertures 29,30 and receiving hole 22 are designed for generally coaxial positioning with an end hole 5 of the air vent cover 3 to permit the extension of a threaded fastener 4 therethrough.

The aperture 29 of one of the arms 26 of each mounting clip 24 adjacent the front face 12 of the frame 11 has an opposing pair of inwardly extending tabs 31,32 designed for receiving the threads of a threaded fastener 4 extended through the respective aperture 29,30 to hold the air vent cover 3 plate to the frame 11 and thereby the building structure 1.

Figure 5:
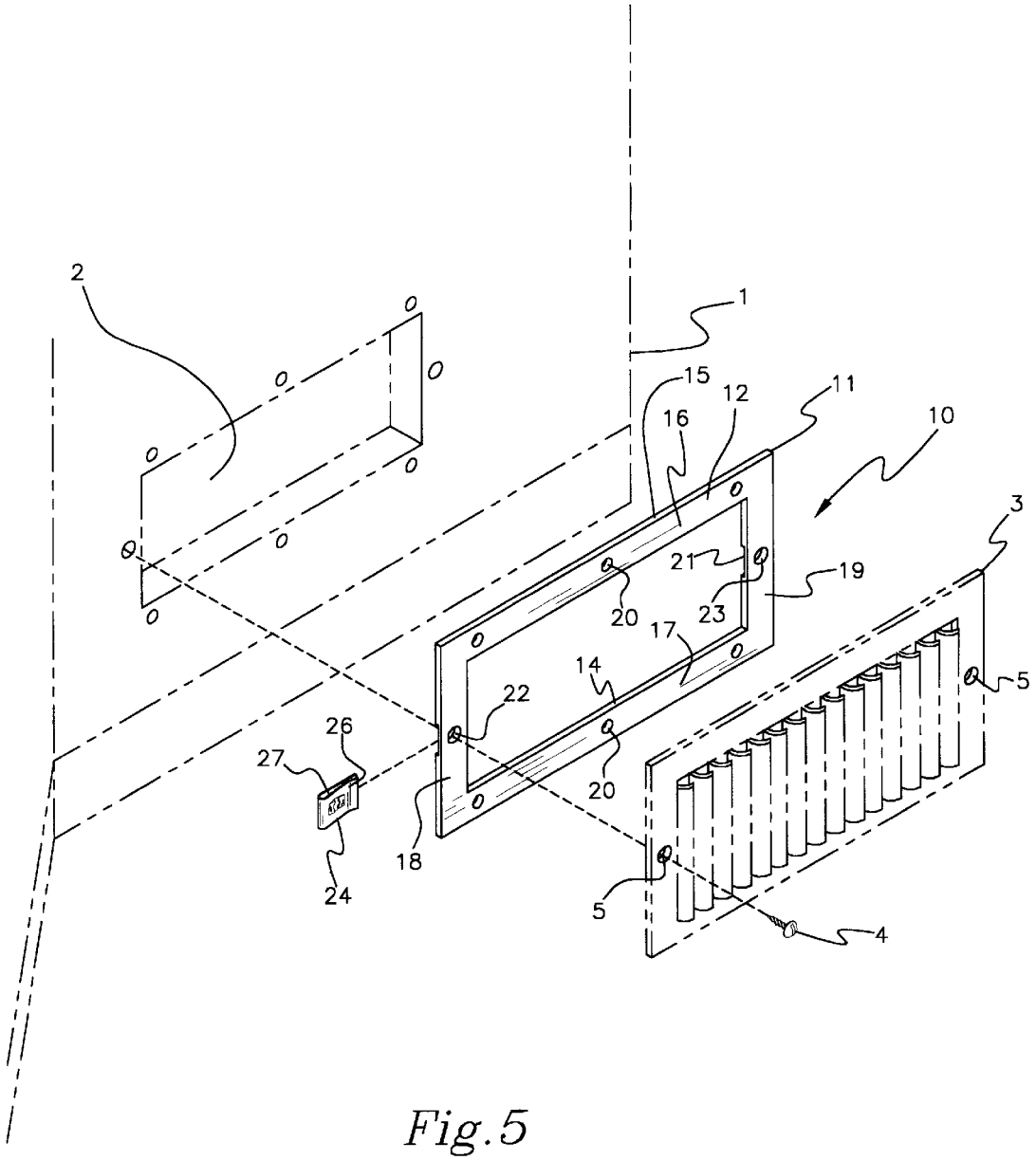
FIG. 5 is a schematic exploded perspective view of the present invention in use to provide a secure coupling between a building structure and an air vent cover.

In use, the frame is mounted to the building structure around the air vent opening in the building structure by extending threaded fasteners into the building structure through the mounting holes. As illustrated in FIG. 5, the frame may be aligned with any holes in the building structure that were originally used to secure the air vent cover to the building structure. The air vent cover is then positioned against the front face of the frame so that the air vent cover covers the central opening and the air vent opening. A pair of threaded fasteners may then be extended through the end holes of the air vent cover and the receiving holes of the frame and the associated apertures of the associated mounting clip. The tabs of the mounting clip threadably engage the threaded fasteners to secure the air vent cover tightly against the building structure without fear of loosening of the air vent cover from the frame.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. In combination:

a building structure having an air vent opening in the building structure, said air vent opening having an outer periphery;

an air vent cover covering said air vent opening;

an open frame being generally rectangular in configuration and having front and back faces, generally rectangular inner and outer perimeter edges, a spaced apart pair of elongate end members and a spaced apart pair of elongate side members extending between said end members, said inner perimeter edge of said frame defining a generally rectangular central opening;

said frame being mounted to the building structure around the periphery of the air vent opening in the building structure such that said back face of said frame abuts the building structure and said center opening of said frame extends around the outer periphery of the air vent opening in the building structure;

the air vent cover abutting against said front face of said frame such that the air vent cover substantially covers said central opening;

said front and back faces of said frame generally lying in generally parallel planes to one another;

said end members of said frame being extended generally parallel to one another, said side members of said frame being extended generally parallel to one another and generally perpendicular to said end members of said frame;

said frame having a thickness defined between said front and back faces of said frame, a length defined between said end members of said frame and a width defined between said side members of said frame;

each of said side members of said frame having a plurality of mounting holes therethrough between said front and back faces of said frame;

wherein said plurality of mounting holes of each of said side member comprises three mounting holes spaced apart along the respective side member at generally equal intervals;

each of said mounting holes being for extending a fastener therethrough into the building structure to secure said frame to the building structure;

each of said end members having a generally rectangular mortise in said back face of the respective end member and extending between said inner and outer perimeter edges of said frame;

each of said mortises being generally positioned on the respective end member at a midpoint between said side members of said frame;

each of said end members of said frame having a receiving hole therethrough between said front and back faces of said frame;

each receiving hole extending through the mortise of the respective end member;

a pair of mounting clips, each of said mounting clips being associated with an end member of said frame;

each of said mounting clips being generally U-shaped and having a pair of resiliently deflectable arms and an arcuate portion connecting said arms together, said arms being biased towards one another;

each mounting clip receiving the associated end member of said frame between said arms of the respective mounting clip such that said mounting clips are held to the associated end members of said frame;

one arm of each mounting clip being positioned fully in the mortise of the associated end member when the mounting clip is coupled to the associated end member;

each of said arms of each mounting clip having an aperture therethrough, said apertures of each mounting clip being generally coaxial to one another;

said apertures of said mounting arms being generally coaxial with the receiving hole of the associated end member of said frame;

each associated group of apertures and receiving hole being generally coaxial positioned with an end hole of the air vent cover to permit the extension of a threaded fastener therethrough; and said aperture of one of said arms of each mounting clip having an opposing pair of inwardly extending tabs adapted for receiving the threads of a threaded fastener extended through the respective aperture to hold the air vent cover plate to the frame and thereby the building structure.

* * * * *